United States Patent [19]

Takenouchi et al.

[11] Patent Number: 4,800,358

[45] Date of Patent: Jan. 24, 1989

[54] FUSE

[75] Inventors: Kenji Takenouchi; Tomohiro Ikeda; Mitsuhiko Tozuka, all of Shizuoka, Japan

[73] Assignee: Yazaki Corporation, Japan

[21] Appl. No.: 122,694

[22] Filed: Nov. 19, 1987

[30] Foreign Application Priority Data

Nov. 19, 1986 [JP] Japan ..... 61-176590[U]
Nov. 19, 1986 [JP] Japan ..... 61-176589[U]

[51] Int. Cl.[4] ..... H01H 85/16

[52] U.S. Cl. ..... 337/268; 337/181; 337/260

[58] Field of Search ..... 337/191, 192, 193, 190, 337/187, 188, 189, 264, 180, 181, 208, 216, 235, 237, 268, 260

[56] References Cited

U.S. PATENT DOCUMENTS 2,658,125 11/1953 Whitfield ..... 337/192
3,909,767 1/1974 Williamson et al. ..... 337/264

FOREIGN PATENT DOCUMENTS 458738 5/1924 Fed. Rep. of Germany ..... 337/181
468973 7/1937 United Kingdom .
470866 9/1937 United Kingdom .
531620 3/1941 United Kingdom .
643561 9/1950 United Kingdom .
676104 7/1952 United Kingdom .
713456 8/1954 United Kingdom .
927239 5/1963 United Kingdom .

*Primary Examiner*—H. Broome
*Attorney, Agent, or Firm*—Wigman & Cohen

[57] ABSTRACT

A fuse to be connected to cable terminals with bolts comprises an electrical insulating housing, a fuse-element disposed in the housing and a pair of fuse contacts each connected at one end to both ends of the fuse element, respectively, and the other ends of the fuse contacts being protruded from the bottom of the housing in parallel with each other, and a notch to which a bolt for connecting a cable terminal to the fuse contact is fitted therein is formed in each fuse contact, and the notch is extended from the other end of the fuse contact toward the other end thereof. The fuse can be replaced without removing the bolt due to the provision of the notches in the fuse contacts, so that the operation efficiency when replaced is improved.

16 Claims, 5 Drawing Sheets

FUSE

BACKGROUND OF THE INVENTION

1. Field of the Invention

This invention relates to a fuse for use in a vehicle such as an automobile to protect a power circuit therein, in particular an improvement in a fuse of the type that is used by connecting fuse contacts thereof to cable terminals of the power circuit with bolts.

2. Description of the Prior Art

In a vehicle such as an automobile, an electric power is usually supplied from a battery mounted in the automobile, and various fuses are disposed to protect the battery from shorts caused in electrical equipments or electrical circuits therein. As a fuse disposed in an electrical circuit in which a relative large amount of electrical current flows, a fuse of the type that has fuse contacts connected to cable terminals in the electrical circuits with bolts to reduce contact resistance at the connecting portions and secure electrical connection therebetween is commonly used.

One of these conventional fuses is for example described in the Publication of the Japanese examined Utility Model Applicatin No. 60-15233, which is shown in FIGS. 1 to 3. As shown in FIG. 1, the conventional fuse 10 comprises an electrical insulating housing 11, a fuse element 12 disposed in said housing 11, a pair of fuse contacts 13 and 13 each connected at one end thereof to both ends of the fuse element 12 and having bolt hole 13*a*, respectively, and a housing cover 14 attached to the housing. The other ends of the fuse contacts 13 and 13 are protruded outside from the bottom of the housing 11 in parallel with each other when assembled.

As shown in FIGS. 2 and 3, the conventional fuse 10 is mounted in a fuse mounting box 15. Said fuse mounting box 15 comprises a pair of fuse accommodating rooms 16 and 16 in which the fuse 10 is mounted, respectively. Each of said fuse accommodating room 16 includes two nuts 17 and 17 to which fixing bolt 18 is fastened, respectively. Cable terminals 19 and 19 each attached to an end of a wire from a power surface side or loading side are connected to the fuse contacts 13 and 13 of the fuse 10, respectively. Each of said cable terminal 19 is fixed to the fuse mounting box 15 by screwing the fixing bolt 18 which passes an aperture 19*a* of the cable terminal 19 and the hole 13*a* of the fuse contact 13 into the nut 17.

The conventional fuse 10 described hereinabove is fixed in the mounting box 15 by inserting the fuse 10 into the fuse accommodating room 16, then adjusting the position of the hole 13*a* of the fuse contact 13 to the position of the nut 17 and putting the cable terminal 19 thereon, and then screwing the fixing bolt 18 which passes the aperture 19*a* of the cable terminal 19 and hole 13*a* of the fuse contact 13 into the nut 17.

In the conventional fuse 10, therefore, there is a disadvantage that the operation efficiency when the fuse is replaced is inferior, since whenever the fuse is removed it is necessary to take the fixing bolt 18 off the nut 17. In addition, there is a possibility that the bolt 18 may be dropped and lost when the fuse is replaced.

Further, once the fuse is mounted, even if the fastening of the bolt is insufficient, it is difficult to find the fact from the outside. In this case, it is not possible to check up the fastening condition of the bolt by pulling out the fuse since the hole 13*a* of the fuse contact 13 is engaged with the fixing bolt 18. As a result, there are problems that a heat generation may be caused in the connecting portion of the fuse contact and cable terminal, and fusion efficiency of the fuse element may be deteriorated due to insufficient connection therebetween.

SUMMARY OF THE INVENTION

In view of the foregoing problems, this invention has been made. Accordingly, an object of this invention to provide a fuse which has a good operation efficiency when mounted to and removed from a fuse mounting box.

Another object of this invention to provide a fuse which can check up the fastening condition of the fixing bolt easily.

Still another object of this invention to provide a fuse which can check up whether a fuse contact of the fuse is fitted to the fixing bolt securely when the fuse is mounted.

In order to achieve the above objects, the fuse according to the present invention comprises an electrical insulating housing, a fuse element disposed in the housing and a pair of fuse contacts each connected at one end to both ends of the fuse element, respectively, and the other ends of the fuse contacts being protruded outside from the bottom portion of the housing in parallel with each other, wherein a notch to which a fixing bolt for connecting a cable terminal on the fuse contact is fitted therein is formed in each fuse contact, and the notch is extended from the other end of the fuse contact toward the one end thereof.

According to the fuse having the above structure, the fitting of the fuse to the mounting box is attained by attaching the cable terminal to the mounting box loosely by the fixing bolt passing an aperture of the cable terminal, then inserting the fuse into the mounting box such that the notch is fitted on a stem of the fixing bolt and the fuse contact is located between the cable terminal and the nut, and then screwing the bolt into the nut. In that state, it can be checked that the connection between the fuse contact and cable terminal is secured, if the fuse can not be moved when it is lifted. Further, when the fuse is removed from the fuse mounting box, it is not necessary to take the bolt off the fuse mounting box. In other words, the fuse can be replaced to keep the bolt mounting on the fuse mounting box. Therefore, the operation of the replacement of the fuse becomes easy due to unnecessary of removal of the fixing bolt. Furthermore, there is no possibility that the bolt may be dropped and lost during the opeation due to the unnecessary.

These and other objects and advantages of the present invention, as well as the details of illustrative embodiments, will be more fully understood from the following description and drawings, in which:

Figure 1:
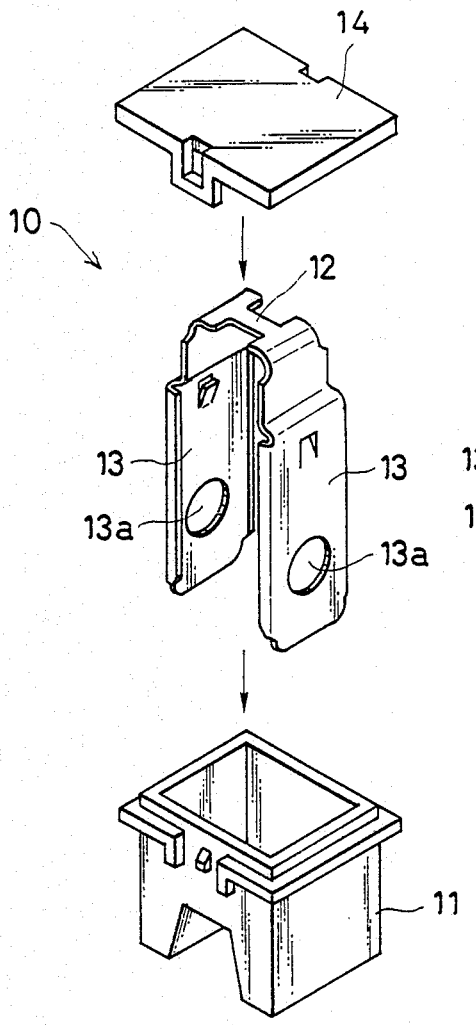
FIG. 1 PRIOR ART
FIG. 1 is a disassembled perspective view of a fuse of a prior art.
Figure 3:
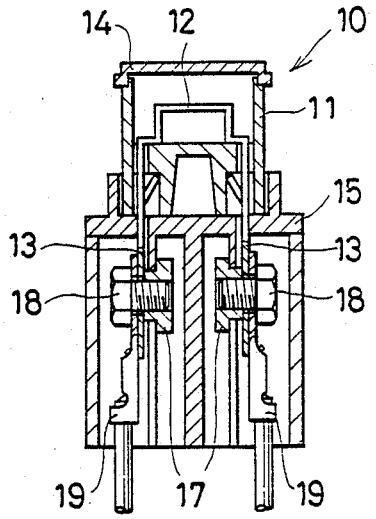
FIG. 3 PRIOR ART
FIG. 3 is a section view showing the condition that the fuse is accommodated in the fuse mounting box.
Figure 2:
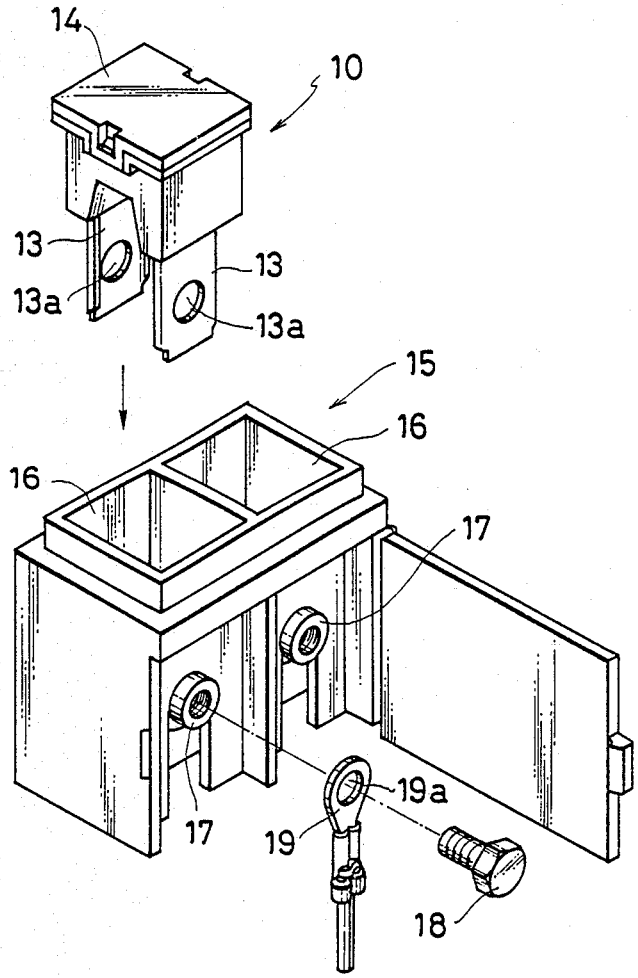
FIG.2 PRIOR ART
FIG. 2 is a perspective view showing the fuse and a fuse mounting box in which the fuse is accommodated.
Figure 4:
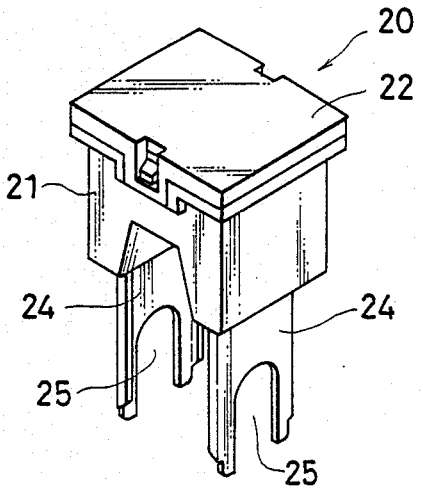
FIG. 4, is a perspective view of a fuse of the first embodiment according to the present invention.
Figure 5:
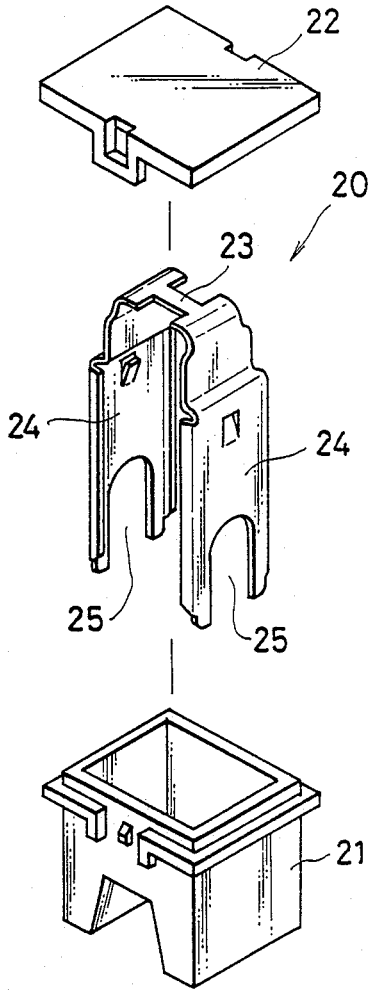
FIG. 5 is a disassembled perspective view of the fuse of the first embodiment.

DETAILED DESCRIPTION OF THE PREFERRED EMBODIMENTS:

Referring now to the drawings FIGS. 4 to 7, there is shown the preferred embodiment of the present invention.

Figure 6:
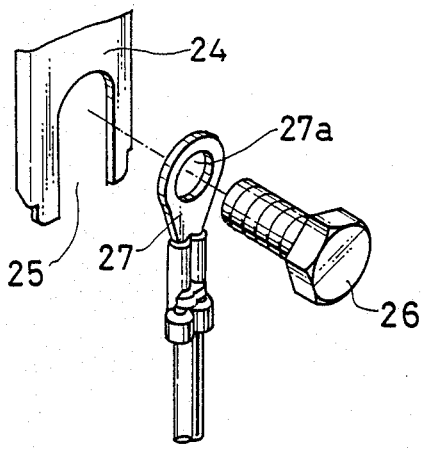
FIG. 6 is a partly enlarged perspective view of a fuse contact of the fuse.
Figure 7:
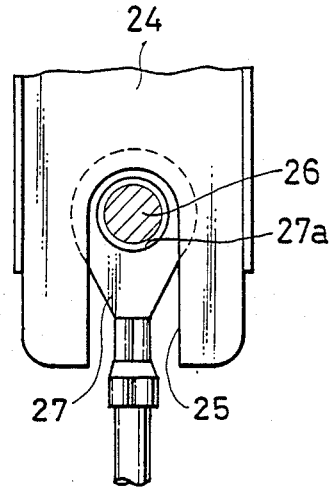
FIG. 7 is an explanatory view showing the condition that a cable terminal is connected to the fuse contact of the fuse.
Figure 8:
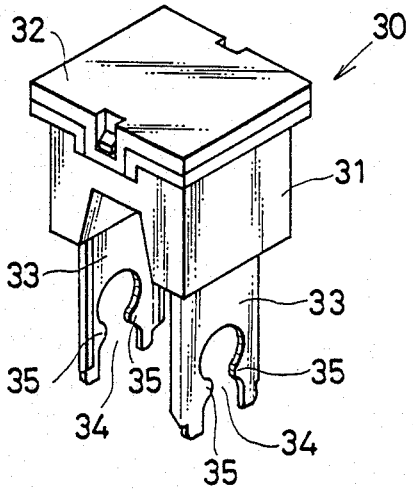
FIG. 8 is a perspective view of a fuse of the second embodiment according to the present invention.
Figure 9:
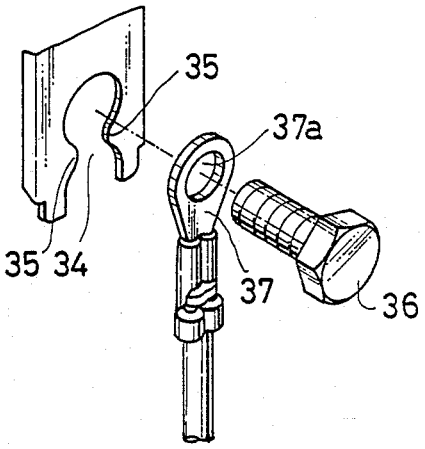
FIG. 9 is a partly enlarged perspective view of a fuse contact of the fuse of the second embodiment.

In the drawings, the numeral 20 indicates a fuse of the first embodiment. Said fuse 20 has an electrical insulating housing 21 formed of heat resistance synthetic resin and a housing cover 22 fitted on the housing 21. In the housing 21, a fuse element 23 and a pair of fuse contacts 24 and 24 each connected at one end thereof to both ends of the fuse element 23 integrally, respectively, are fixedly disposed. The other ends of the fuse contacts 24 and 24 are protruded outside from the bottom portion of the housing 21 in parallel with each other. U-shaped notch 25 to which a fixing bolt 26 for connecting a cable terminal 27 to the fuse contact 24 is formed in each fuse contact 24, which extends from the other end of the fuse contact 24 toward the one end thereof. As shown in FIGS. 6 and 7, the width of the notch 25 is slightly larger than the diameter of the fixing bolt 26 to be screwed into a nut of a fuse mounting box (not shown) in which the fuse 20 is accommodated.

In use, the fuse 20 having the above structure is mounted in the mounting box by attaching the cable terminals 27 and 27 to the mounting box by loosely screwing the fixing bolts 26 and 26 which passes the aperture 27a of the cable terminal 27 into the nuts, respectively, then inserting the fuse 20 into the mounting box such that the notch 25 is fitted on a stem of the fixing bolt 26 and the fuse contact 24 is located between the cable terminal 27 and the nut, and then fastening the bolt 26 on the nut.

The fuse 20 having the above structure can be used instead of the conventional fuse described hereinbefore.

In the fuse according to the present invention, since the notch 25 to which the fixing bolt 26 is fitted is formed on each fuse contact 24, which extends from the top side thereof toward the base portion thereof, it is possible to remove the fuse 20 from the fuse mounting box or to mount it in the box to keep the bolts 26 mounting on the mounting box. In other words, the fuse 20 can be removed only by loosing the bolts 26. As a result, the replacement of the fuse 20 to the mounting box can be carried out easily and rapidly. In addition, there is no possibility that the fixing bolt 26 may be dropped and lost during the replacement operation. Further, the fastening condition of the fixing bolt 26 can be easily checked only by pulling out the fuse, it can be prevented that imperfect connection is occurred between the fuse contact 24 and the cable terminal 27.

FIGS. 8 to 11 show the other embodiment of a fuse of the present invention.

Figure 10:
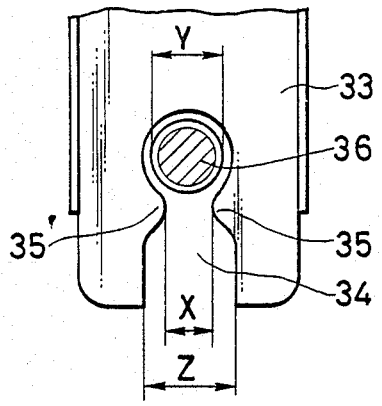
FIG. 10 is an explanatory view showing the shape and size of a notch of the fuse contact of the fuse.

The fuse 30 of this embodiment also comprises an electrical insulating housing 31 and a housing cover 32 fitted on the housing 31. In the housing 31, a fuse element (not shown) and a pair of fuse contacts 33 and 33 each connected at one end to both ends of the fuse element, respectively, are fixedly disposed. The other ends of the fuse contacts 33 and 33 are protruded outside from the bottom of the housing 31 in parallel with each other. The structure described above is same as that of the first embodiment. On each fuse contact 33, U-shaped notch 34 to which a fixing bolt 36 for connecting a cable terminal 37 to the fuse contact 33 is formed in each fuse contact 33, which extends from the other side toward the one side is formed. On middle portions of both sides of each notch 34, a pair of protruding portions 35 and 35 each having a substantially semicircular shape are formed, respectively. The top portion of each protruding portion 35 is formed smoothly. As shown in FIG. 10, the width "X" between the protruding portions 35 and 35 is slightly smaller than the diameter "Y" of a stem portion of the fixing bolt 36, while the width "Z" which indicates the width of the notch except for the protruding portions is larger than the diameter "Y".

Figure 11:
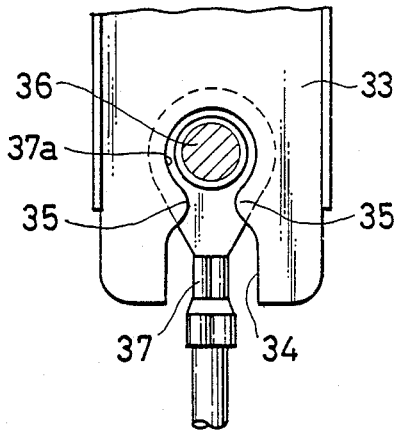
FIG. 11 is an explanatory view showing the condition that a cable terminal is connected to the fuse contact of the fuse.

Thus formed fuse 30 is mounted to the fuse mounting box to which the bolts 36 are loosely screwed before hand in the same manner as the fuse of the first embodiment. Then, the fuse 30 can be easily inserted until the protruding portions 35 and 35 of the notch 34 of each fuse contact 33 come to contact with the bolt 36. However, when the protruding portions 35 and 35 are abutted on the bolt 36, the insertion resistance suddenly becomes large and then the protruding portions 35 and 35 are flexed. When the bolt 36 passes beyond the protruding portions 35 and 35, the resistance decreases suddenly so that the bolt 36 moves forward until it abuts on the end portion of the notch 34. In this state, the contact area between the cable terminal 37 and fuse contact 33 becomes the maximum due to the contribution of the protruding portions 35 and 35, as shown in FIG. 11.

Figure 12:
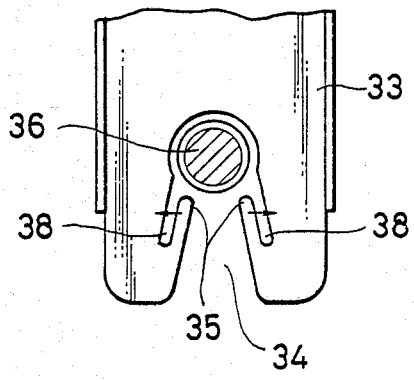
FIG. 12 is an explanatory view showing a modification of the shape of the notch of the fuse contact of the second embodiment.
Figure 13:
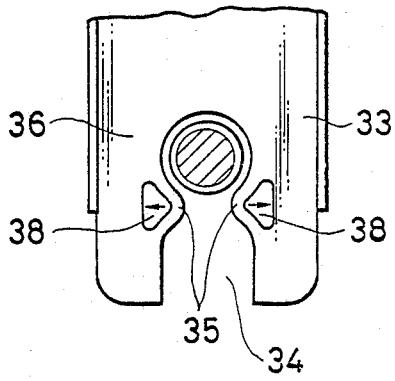
FIG. 13 is an explanatory view showing the other modification of the shape of the notch.

FIGS. 12 and 13 show modifications of the shape of the notch in the fuse contact of the second embodiment.

In the modification in FIG. 12, each protruding portion 35 has a cantilever shape protruding inclinedly toward the end portion of the notch 34 and a flexural space 38 is formed behind it. The tip portions of the protruding portions are formed semicircularly. In this embodiment, the distance between the top portions of the protruding portions 35 and 35 is slightly smaller than the diameter of of stem of the fixing bolt 36. However, the bolt 36 can be passed between the top portions of the protruding portions 35 and 35 with some contact resistance, since the protruding portions 35 and 35 are easily deformed due to the provision of the flexural spaces 38 and 38.

In the modification in FIG. 13, each protruding portion 35 has substantially same shape as that of the protruding portion in FIGS. 8 to 11. However, in this modification, a flexural space 38 having a substantially triangular shape is formed inside of each protruding portion 35. Of course, the distance between the protruding portions is slightly smaller than the diameter of the bolt 36. In the modification, by the provision of the flexural spaces 38 and 38, flexibility of the protruding portions 35 and 35 are relatively increased.

These fuses having the above structures can be used instead of the conventional fuse since they have the same internal structures as those of the conventional fuse. However, according to the fuse of the second embodiment, the following results can be obtained in addition to the result of the first embodiment. Namely, upon inserting the fuse into the fuse mounting box, any contact resistance is caused when the protruding portions of the notch are passed over the fixing bolt, so that it is possible to confirm that the notch can be fitted on the bolt correctly by checking whether there has been the contact resistance during the insertion of the fuse.

Further, since there is a sufficient electrical contacting area between the fuse contact and the cable terminal when the fuse is correctly mounted, there is little possibility that a heat resistance is generated in the fuse contacts, so that it is also possible to protect the electric circuit statably.

It must be understood that the invention is in no way limited to the above embodiments and that many changes may be brought therein without departing from the scope of the invention as defined by the appended claims.

What is claimed is:

1. A fuse adapted to be connected to cable terminals with bolts, comprising:

an electrical insulating housing having a bottom portion;

a pair of fuse contacts having first and second ends, said first ends being disposed within said housing and said second ends extending out through the bottom portion of said housing, and each of said fuse contacts having a notch formed at said second end;

a fuse element disposed within said housing and electrically connected to the first ends of said fuse contacts; and a pair of protruding portions formed at each end of said second ends and extending into a middle section of said notch such that the distance between said protruding portions is slightly smaller than the diameter of a stem portion of said bolt.

2. A fuse adapted to be connected to cable terminals with bolts as set forth in claim 1, wherein each of said protruding portions has a substantially semicircular shape.

3. A fuse adapted to be connected to cable terminals with bolts as set forth in claim 1, wherein said notch has an end portion, and each of said protruding portions has a cantilever shape protruding inclinedly toward said end portion, and flexural spaces are formed behind the protruding portions, respectively.

4. A fuse adapted to be connected to cable terminals with bolts as set forth in claim 1, wherein each of said protruding portions has a substantially semicircular shape,, and flexural spaces are formed inside the protruding portions, respectively.

5. A fuse adapted to be connected to cable terminals with bolts as set forth in claim 2, wherein said protruding portions are formed smoothly such that the protruding portions can be passed over the bolt easily.

6. A fuse adapted to be connected to cable terminals with bolts as set forth in claim 2, wherein said protruding portions are designed so as to contact with said cable terminal partly when said outer terminal is connected.

7. A fuse adapted to be connected to cable terminals with bolts as set forth in claim 3, wherein said protruding portions are formed smoothly such that the protruding portions can be passed over the bolt easily.

8. A fuse adapted to be connected to cable terminals with bolts as set forth in claim 4, wherein said protruding portions are formed smoothly such that the protruding portions can be passed over the bolt easily.

9. A fuse adapted to be connected to cable terminals with bolts as set forth in claim 3, wherein said protruding portions are designed so as to contact with said cable terminal partly when said outer terminal is connected.

10. A fuse adapted to be connected to cable terminals with bolts as set forth in claim 4, wherein said protruding portions are designed so as to contact with said cable terminal partly when said outer terminal is connected.

11. A fuse adapted to be connected to cable terminals with bolts, comprising:

an electrical insulating housing having a bottom portion;

a pair of fuse contacts having first and second ends, said first ends being disposed within said housing and said second ends extending out through the bottom portion of said housing, and each of said fuse contacts having a notch formed at said second end;

a fuse element disposed within said housing and electrically connected to the first ends of said fuse contacts; and means for flexibly abuting a stem portion of said bolt in order to confirm a proper engagement of said fuse with said bolt, said flexible abutment means provided at the second end of each of said fuse contacts and protruding into the notch of said fuse contacts so as to partially partition the notch into an entrance slot section and a circular-like hollow section, wherein said flexible abutment means forms an abutment region having a width at its narrowest point smaller than the diameter of the circular-like hollow section and slightly smaller than the diameter of the stem portion of said bolt.

12. A fuse adapted to be connected to cable terminals with bolts as set forth in claim 11, wherein said flexible abutment means is integrally formed from said fuse contact in order to provide a greater electrical contact area between said fuse contact and said cable terminal.

13. A fuse adapted to be connected to cable terminals with bolts as set forth in claim 12, wherein said flexible abutment means comprises a pair of protruding portions, said protruding portions extending into the notch from opposite walls of said fuse contact facing the notch.

14. A fuse adapted to be connected to cable terminals with bolts as set forth in claim 13, wherein each of said protruding portions has a substantially semicircular shape.

15. A fuse adapted to be connected to cable terminals with bolts as set forth in claim 13, wherein a flexural space is formed inside each of said protruding portions to allow greater flexibility of said protruding portions.

16. A fuse adapted to be connected to cable terminals with bolts as set forth in claim 13, wherein each of said protruding portions has a cantilever shape inclining in a direction substantially towards the circular-like hollow section, said cantilever shaped protruding portions having a flexural space formed therebehind.

* * * * *